US009567999B2

(12) United States Patent
Ferretti et al.

(10) Patent No.: US 9,567,999 B2
(45) Date of Patent: Feb. 14, 2017

(54) GEAR PUMP OR HYDRAULIC GEAR MOTOR WITH HELICAL TOOTHING PROVIDED WITH HYDRAULIC SYSTEM FOR AXIAL THRUST BALANCE

(71) Applicant: MARZOCCHI POMPE S.P.A., Casalecchio di Reno (BO) (IT)

(72) Inventors: Stefano Ferretti, Marzabotto (IT); Danilo Persici, Calderara di Reno (IT)

(73) Assignee: MARZOCCHI POMPE S.P.A., Casalecchio di Reno (BO) (IT)

( * ) Notice: Subject to any disclaimer, the term of this patent is extended or adjusted under 35 U.S.C. 154(b) by 209 days.

(21) Appl. No.: 14/401,465

(22) PCT Filed: May 20, 2014

(86) PCT No.: PCT/EP2014/060297
§ 371 (c)(1),
(2) Date: Nov. 14, 2014

(87) PCT Pub. No.: WO2014/191253
PCT Pub. Date: Dec. 4, 2014

(65) Prior Publication Data

US 2016/0265528 A1 Sep. 15, 2016

(30) Foreign Application Priority Data

May 30, 2013 (IT) ..... AN13A0102

(51) Int. Cl.
*F03C 2/00* (2006.01)
*F03C 4/00* (2006.01)
(Continued)

(52) U.S. Cl.
CPC ..... *F04C 15/0042* (2013.01); *F01C 1/084* (2013.01); *F01C 21/003* (2013.01); *F04C 2/084* (2013.01);
(Continued)

(58) Field of Classification Search
CPC ..... F04C 2/086; F04C 2/16; F04C 2/18; F04C 18/086; F04C 18/16; F04C 18/18; F04C 23/001; F04C 15/0023; F04C 15/0026; F04C 15/0042; F04C 29/0021; F04C 2240/50; F04C 2240/56
(Continued)

(56) References Cited

U.S. PATENT DOCUMENTS 2,159,744 A * 5/1939 Maglott ..... F04C 2/084 418/201.3
2,462,924 A 3/1949 Ungar
(Continued)

FOREIGN PATENT DOCUMENTS

DE 102009012853 A1 9/2010
EP 2154372 A1 2/2010

OTHER PUBLICATIONS

International Search Report for corresponding International Application No. PCT/EP2014/060297.

*Primary Examiner* — Theresa Trieu
(74) *Attorney, Agent, or Firm* — Egbert Law Offices, PLLC

(57) ABSTRACT

A gear pump has a toothed driving wheel, a toothed driven wheel, a front flange from which a projecting portion of the shaft protrudes, being connected to the shaft of the driving wheel, a back lid fixed to the case, and an intermediate flange between the case and the front flange. The intermediate flange has first and second chambers connected by a connection duct to the inlet or outlet fluid duct of the pump. A compensating ring is mounted in the first chamber and inserted on the shaft of the driving wheel to compensate the axial forces of the driving wheel and transmit the motion on the shaft of the driving wheel. A piston is mounted in the second chamber in order to stop against one end of the shaft
(Continued)

of the driven wheel, in such manner to compensate the axial forces imposed on the toothed driven wheel.

11 Claims, 17 Drawing Sheets

(51) Int. Cl.

| | |
|---|---|
| ***F04C 2/00*** | (2006.01) |
| ***F04C 18/00*** | (2006.01) |
| ***F04C 15/00*** | (2006.01) |
| ***F04C 18/18*** | (2006.01) |
| ***F04C 2/16*** | (2006.01) |
| ***F04C 18/16*** | (2006.01) |
| ***F04C 29/00*** | (2006.01) |
| ***F04C 2/18*** | (2006.01) |
| ***F04C 2/08*** | (2006.01) |
| ***F01C 1/08*** | (2006.01) |
| ***F01C 21/00*** | (2006.01) |

(52) U.S. Cl.
CPC . *F04C 2/16* (2013.01); *F04C 2/18* (2013.01); *F04C 15/0023* (2013.01); *F04C 15/0026* (2013.01); *F04C 18/16* (2013.01); *F04C 18/18* (2013.01); *F04C 29/0021* (2013.01); *F04C 2240/50* (2013.01); *F04C 2240/56* (2013.01)

(58) Field of Classification Search
USPC ..... 418/9, 132, 201.1, 203, 206.1–206.9
See application file for complete search history.

(56) References Cited

U.S. PATENT DOCUMENTS

| | | | | | |
|---|---|---|---|---|---|
| 3,104,616 | A * | 9/1963 | Peet | F04C 15/0026 | 418/132 |
| 3,164,099 | A * | 1/1965 | Hitosi | F04C 2/084 | 418/201.3 |
| 3,658,452 | A * | 4/1972 | Kita | F04C 15/0042 | 418/203 |
| 4,245,969 | A * | 1/1981 | Caslow | F04C 15/0026 | 418/132 |
| 6,887,055 | B2 * | 5/2005 | Morselli | F04C 15/0026 | 418/132 |
| 2007/0098586 | A1 | 5/2007 | Clark | | |

* cited by examiner

GEAR PUMP OR HYDRAULIC GEAR MOTOR WITH HELICAL TOOTHING PROVIDED WITH HYDRAULIC SYSTEM FOR AXIAL THRUST BALANCE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to gear pumps and hydraulic gear motors, in particular to a hydraulic system used to balance the axial thrusts in pumps and hydraulic motors with external gears of bi-directional type or multiple stages, wherein helical gears are provided.

2. Description of Related Art Including Information Disclosed Under 37 CFR 1.97 and 37 CFR 1.98

Although specific reference is made to gear pumps hereinafter, the present invention also relates to hydraulic gear motors. Gear motors have the same construction as gear pumps, although they differ in the operating principle: whereas pumps are used to convert mechanical energy (torque applied to the drive shaft) into hydraulic energy (pressurized oil), motors are used to convert hydraulic energy (pressurized oil) into mechanical energy. The pressurized oil that is conveyed inside the hydraulic motor through one of the ports provided on the motor body acts on the toothed wheels by driving them into rotation; the torque is the output available at the shaft whereon a load is applied.

External gear pumps are commonly used in numerous industrial sectors, such as the automotive, earthworks, automation and control industries.

As shown in FIGS. 1 and 1A, a gear pump generally comprises two mutually engaged toothed wheels (1, 2). The toothed wheels (1, 2) are disposed inside a case (3) in such a way to define an inlet fluid area and an outlet fluid area.

One of the toothed wheels, which is defined as driving wheel (1), receives motion from a drive shaft, whereas the other toothed wheel, which is defined as driven wheel (2), receives motion from the driving wheel (1) it engages with. The toothed wheels (1, 2) are joined to respective shafts (10, 20) revolvingly supported by supports or bushes (4, 5).

In this description the term "front" refers to the side of the pump from which the shaft of the driving wheel protrudes, i.e. the inlet shaft that receives the rotation.

The pump comprises a front bush (4) that revolvingly supports a front portion of the shafts of the toothed wheels and a rear bush (5) that revolvingly supports a rear portion of the shafts of the toothed wheels. Each bush is provided with two circular housings that revolvingly support a portion of the shafts of the two toothed wheels.

A front flange (6) and a back lid (7) are fixed to the case (3) in such way to close the bushes (4, 5) and the toothed wheels (1, 2) inside a box composed of the case (3), the front flange (6) and the back lid (7). The front flange (6) is provided with an opening from which the shaft (10) of the driving wheel (1) comes out. Therefore a projecting portion (13) of the shaft of the driving wheel frontally protrudes from the front flange (6) in order to be connected to a drive shaft that transmits motion.

Gear pumps are volumetric machines because the volume comprised between the compartments of the teeth of the two toothed wheels and the external case is transferred from the inlet area to the outlet area by means of the rotation of the toothed wheels. Different types of fluid can be used, as well as different outlet and/or inlet pressure and pump displacement values.

The fluid used in the most typical application is oil, which is partially incompressible. Reference pressure values are typically the ambient pressure for the inlet pressure, whereas the outlet pressure reaches maximum values of 300 bar.

As shown in the example of FIGS. 1 and 1A, the toothed wheels (1, 2) have a straight external toothing, the same dimensions and a unitary transmission ratio.

Referring to FIG. 2, if toothed wheels with straight toothing are used, during operation the toothed wheels transmit a transmission force (F) that can be decomposed into a radial transmission force component (Fr) (shown in FIG. 2) directed in radial direction with respect to the axis of rotation of the toothed wheels and a transverse transmission force component (Ft) (not shown in FIG. 2) directed in radial direction with respect to the axis of rotation of the toothed wheels.

Referring to FIG. 2A, in these conditions, a pressure force (P) is generated in the inlet area (shown in bold in the left-hand side of FIG. 2A), which acts on the surfaces of the toothed wheels. The resultant of the pressure force (P) can be likewise decomposed in two components: a radial pressure force component (Pr) and a transverse pressure force component (Pt). In such a case, no force in axial direction is exerted on the toothed wheels.

The use of helical gears, when configured as disclosed in the international patent application PCT/EP2009/066127 or in the U.S. Pat. No. 2,159,744 or U.S. Pat. No. 3,164,099, allows for considerably reducing the noise and pulses induced by the pump in the hydraulic circuit.

It must be noted that in order to correctly engage two helical toothed wheels with the same geometrical features, the inclination of the helix must have a discordant direction.

FIGS. 3A, 3B, 3C and 3D disclose a gear pump with a driving wheel (1) and a driven wheel (2) with helical toothing. The use of toothed wheels with helical toothing generates axial loads or stress (Fa, Pa) during operation. The higher the helix angle ?b of the helical toothing is, the higher said axial loads or stress (Fa, Pa) will be (FIGS. 3A, 3B). The generation of the axial stress (Fa, Pa) is caused by the projection of the transmission forces (Fa) and the pressure forces (Pa) acting on the sections of the toothed wheels along the axial direction.

FIG. 3D shows the resultants (A, B) of all axial forces acting on the toothed wheels (1, 2), respectively.

If not opposed, the generation of the axial stress (A, B) considerably increases the specific pressure that is discharged on the bushes (4, 5), thus reducing both the mechanical efficiency because of losses by friction and the reliability and maximum pressure of the pump.

The problem of balancing the axial loads can be solved in different ways.

Referring to FIG. 4, the use of bi-helical gears is known to solve the problem of balancing the axial loads, because the axial forces (A, B) are directly balanced on the toothed wheels. Such a solution is impaired by several drawbacks: in fact, the higher constructional complexity of the bi-helical toothed wheels, together with the higher accuracy required during the construction of the high-pressure gear pumps or motors, makes such a solution cost ineffective.

An alternative method used to balance the axial forces is disclosed in the U.S. Pat. No. 3,658,452, wherein a right-hand pump (i.e. a pump with driving shaft with clockwise rotating right-hand helix) and driven shaft with left-hand helix are used.

Referring to FIG. 5 (which corresponds to FIG. 1 of U.S. Pat. No. 3,658,452) the axial forces (A, B) acting on the driving and driven toothed wheels (11, 12) of the pump are both directed towards the back lid (16) and opposed by hydraulic pistons (51, 52) disposed at the ends of the toothed wheels, which exert contrast forces (A', B'). The hydraulic pistons (51, 52) are fed by means of passages (59, 60, 61) that connect the rear chambers (57 and 58) of the hydraulic pistons with the inlet area of the pump. The area of the hydraulic pistons (51, 52) must be suitably dimensioned in order to balance the axial forces (A, B).

The axial forces (A, B) acting on the toothed wheels are generated by the contribution of two factors: the axial component of the pressure (Pa) (FIG. 3B) and the axial component of the force (Fa) generated by the torque transmission from the driving wheel to the driven wheel (FIG. 3A). Regardless of the direction of rotation and the direction of the helix used for the wheels, the forces (Pa and Fa) are always concordant on the driving wheel, whereas the forces (Pa and Fa) are always discordant on the driven wheel.

$$A=Pa+Fa[N] \tag{1}$$

$$B=Pa-Fa[N] \tag{2}$$

If a pump with helical gears according to the prior art in right-hand rotation (clockwise-rotating driving shaft) is considered and a driving shaft with right-hand helix is used (FIG. 5), at a known running speed, the absorbed torque at the driving shaft is:

$$Mt = \frac{V \cdot P}{20 \cdot \pi \cdot \eta_m}[\mathrm{Nm}] \tag{3}$$

V=Displacement [$cm^3$/rev]

P=Pressure difference between inlet and outlet [bar]

$n_m$=Hydro-mechanical output (experimentally obtainable value)

Assuming that half of the torque is transferred to the fluid by the driving wheel during its pumping action, the torque transmitted to the driven wheel $Mt_{cto}$ is half of the total torque.

$$Mt_{CTO} = \frac{Mt}{2}[\mathrm{Nm}] \tag{4}$$

The axial transmission force Fa generated by the helical toothed wheels is:

$$Fa = \frac{1000 \cdot Mt_{CTO}}{\frac{Dp}{2}} \cdot \mathrm{Tan}(\beta) = \frac{50 \cdot V \cdot P}{\pi \cdot Dp \cdot \eta_m} \cdot \mathrm{Tan}(\beta)[\mathrm{N}] \tag{5}$$

Dp=Operating pitch diameter of toothed wheels [mm]

β=Inclination angle of helix [°]

Because of the known action and reaction principle, the force Fa acts on the driving and driven wheel with the same intensity, but with opposite direction.

The axial force generated by the pressure Pa is the resultant of the pressure along the axial direction:

$$Pa = \frac{h \cdot l \cdot P \cdot \mathrm{Tan}(\beta)}{10}[\mathrm{N}] \tag{6}$$

h=Tooth height [mm]

l=Ring width [mm]

In view of the above, the force Pa has the same intensity and the same direction on both toothed wheels. According to the most typical dimensioning of the toothed wheels, Pa>Fa and consequently the forces F1 and F2 always have a concordant direction.

The diameters $\Phi_A$ and $\Phi_B$ of the compensating pistons are obtained from the formulas (7) and (8):

$$\Phi_A = 2 \cdot \sqrt{\frac{10 \cdot A}{\pi \cdot P}}\ [\mathrm{mm}] \tag{7}$$

$$\Phi_B = 2 \cdot \sqrt{\frac{10 \cdot B}{\pi \cdot P}}\ [\mathrm{mm}] \tag{8}$$

Both forces Fa and Pa linearly depend on the value of the inlet pressure P (see formulas (5) (6)). Consequently, after calculating the diameter of the compensating pistons, the axial forces are completely balanced at any value of the pressure P.

The use of the compensating pistons is a rather inexpensive and easy-to-make solution because the work operations and the parts are simple and reliable. The precepts disclosed by the U.S. Pat. No. 3,658,452 can solve the problem of balancing the axial forces only in case of monodirectional motors, in which the resultant forces A and B must be always directed towards the back lid (see FIG. 5), (i.e. in case of a right-hand pump with right-hand driving gear and left-hand driven gear, or in case of a left-hand pump with left-hand driving gear and right-hand driven gear).

However, some hydraulically controlled applications require the use of bi-directional or multiple stage hydraulic pumps or gears.

The use of bidirectional pumps (with two flow directions) allows for inverting the rotation of the driving shaft, thus inverting the direction of the oil flow and the high and low pressure areas, inverting, for instance, the motion of hydraulic actuators. Likewise, the use of bidirectional motors is useful in the applications that require inverting the direction of the torque available at the outlet shaft of the hydraulic motor.

FIG. 6A shows the distribution of the axial forces in case of a bidirectional pump, in an operating condition in which the axial forces A and B are directed towards the front flange. In such a case, the solution disclosed in U.S. Pat. No. 3,658,452 is not applicable because the inversion of the motion and of the inlet side with the outlet side results in the inversion of the axial forces (A, B) acting on the toothed wheels (1, 2), as shown in FIG. 6B. In such a case the axial forces (A, B) are directed towards the front flange (6) and not towards the back lid (7). Because of the inevitable projecting portion (13) of the shaft of the driving wheel (1) that protrudes from the front flange (6), the axial force (A) on the driving wheel (1) can no longer be balanced by means of a hydraulic piston, like in the solution shown in FIG. 5.

The same situation is found in a hydraulic motor with a high-pressure fluid inlet side and a low-pressure fluid outlet side. In such a case, there are no driving wheel and driven wheel, but simply a first toothed wheel (1) and a second toothed wheel (2). Moreover, the projecting portion of the shaft (13) is adapted to be connected to a load, not to a motor.

FIG. 7 shows a multiple two-stage pump comprising a front stage ($S_A$) and a rear stage ($S_B$). For the sake of clarity, FIG. 7 shows a two-stage pump, but the solution can be applied also to a higher number of stages. A multiple pump is necessary to connect multiple independent circuits to a single power take-off. In such a case the pumps are connected in parallel and the rear stage ($S_B$) receives the necessary torque by means of a mechanical connection (500) (such as Oldham coupling or splined coupling), from the shaft of the driving wheel of the front stage ($S_A$). Also in the case of multiple pumps, the solution disclosed in the U.S. Pat. No. 3,658,452 is not applicable because an end portion (T) of the shaft of one of the toothed wheels of the front stage ($S_A$) is engaged to transmit the motion to the rear stage ($S_B$). In fact, the front stage ($S_A$) cannot be provided with a closed back lid because the end portion (T) of the shaft of a toothed wheel must protrude in the back to transmit the motion to the rear stage ($S_B$).

In general, the precepts disclosed by the U.S. Pat. No. 3,658,452 are not applicable when the axial forces (A, B) are directed towards a side of the pump that is crossed by the shaft of a toothed wheel.

The purpose of the present invention is to remedy the drawbacks of the prior art, by providing a hydraulic system to balance the axial forces in gear pumps or hydraulic motors with helical toothing of bidirectional or multiple stage type.

BRIEF SUMMARY OF THE INVENTION

Advantageous embodiments appear from the dependent claims.

The gear pump or motor of the invention comprises:

a first toothed wheel joined to a shaft, a second toothed wheel joined to a shaft and engaging with the first toothed wheel, supports that revolvingly support the shafts of the toothed wheels, a case that contains the supports and defining an inlet fluid duct and an outlet fluid duct, a front flange from which a protruding portion of shaft protrudes frontally, being connected to the shaft of the first toothed wheel, said protruding portion of shaft being adapted to be connected to a motor or a load, and a back lid fixed to the case, wherein the toothing of said toothed wheels is of helical type.

The gear pump or motor of the invention also comprises:

an intermediate flange disposed between said case and said front flange, said intermediate flange comprising a first chamber connected by means of a connection duct to the inlet or outlet fluid duct;

a compensating ring mounted in said first chamber of the intermediate flange and inserted on a portion of said shaft of the first toothed wheel, in such manner to compensate the axial forces imposed on the first toothed wheel and allow for motion transmission on the shaft of the first toothed wheel, wherein said compensating ring comprises an internally empty cylinder and a collar that protrudes radially from the cylinder, wherein the external diameters of the cylinder and the collar are chosen in such manner to compensate the axial forces imposed on the first toothed wheel.

The advantages of the compensation system of the axial forces applied to the gear pump or motor are evident. In fact, such a compensation system of the axial forces, by means of the compensating ring, allows for balancing the axial forces of the first gear and simultaneously transmitting the motion from the shaft of the first gear to another shaft.

BRIEF DESCRIPTION OF THE DRAWINGS

Additional characteristics of the invention will appear evident from the detailed description below, with reference to the attached drawings, which have an illustrative, not limitative purpose only, wherein.

DETAILED DESCRIPTION OF THE INVENTION

Figure 1A:
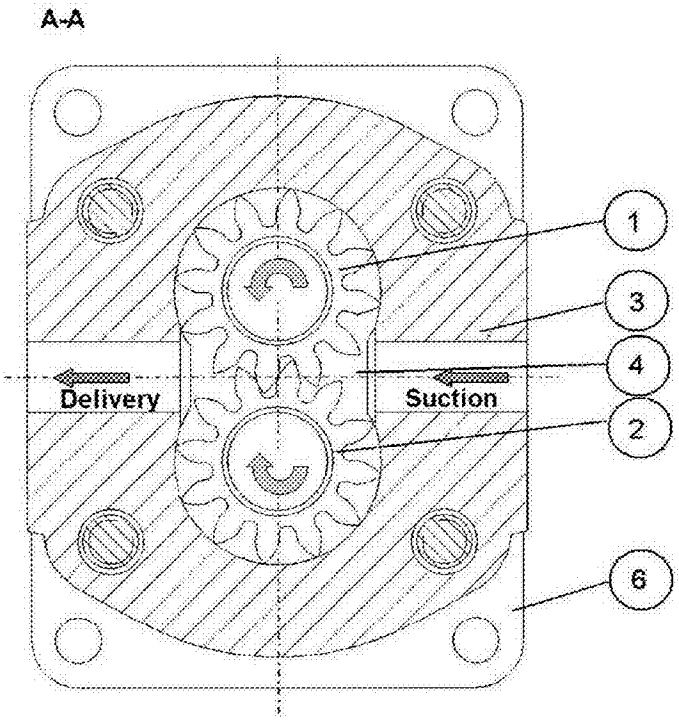
FIG. 1A PRIOR ART
FIG. 1A is a cross-sectional view along section plane A-A of FIG. 1.
Figure 1:
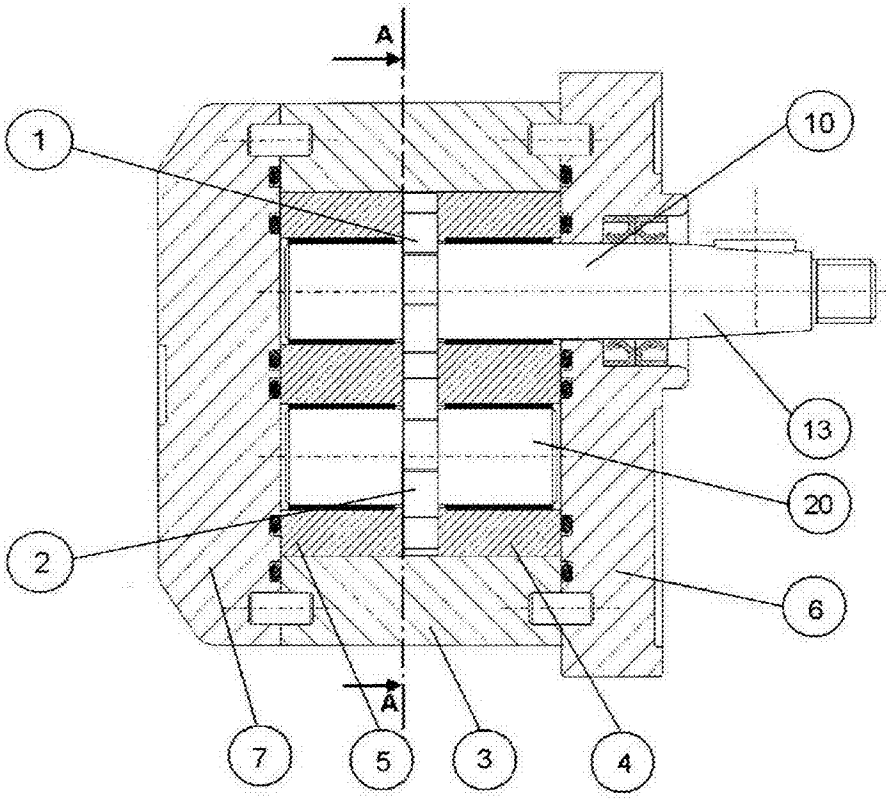
FIG. 1 PRIOR ART
FIG. 1 is an axial view of a gear pump with straight toothing according to the prior art.
Figure 2A:
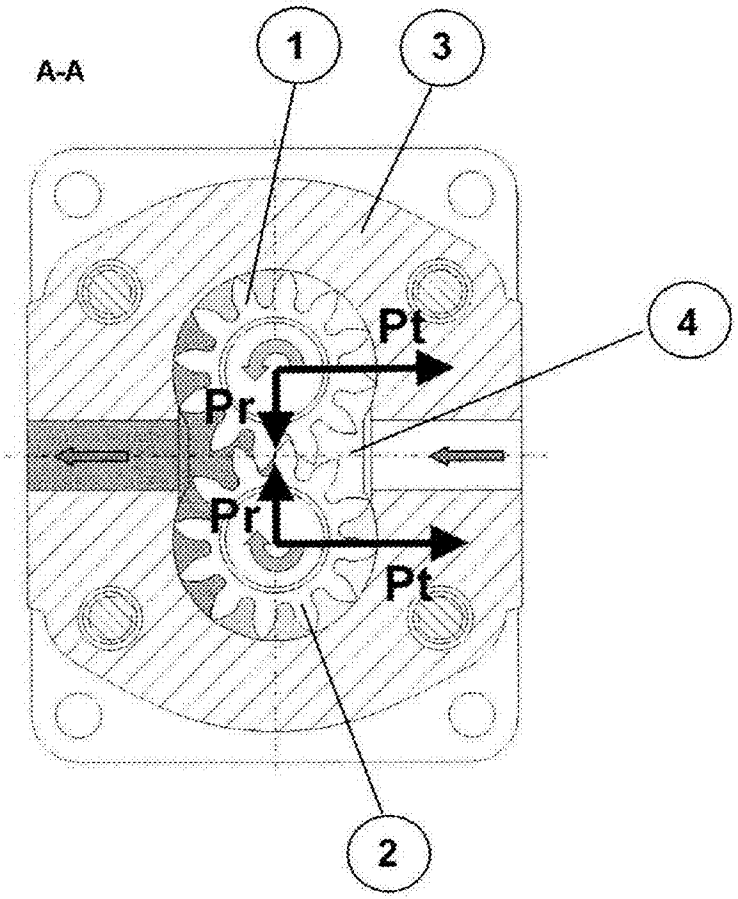
FIG. 2A PRIOR ART
FIG. 2A is the same view as FIG. 1A, which shows the radial and transverse pressure forces.
Figure 2:
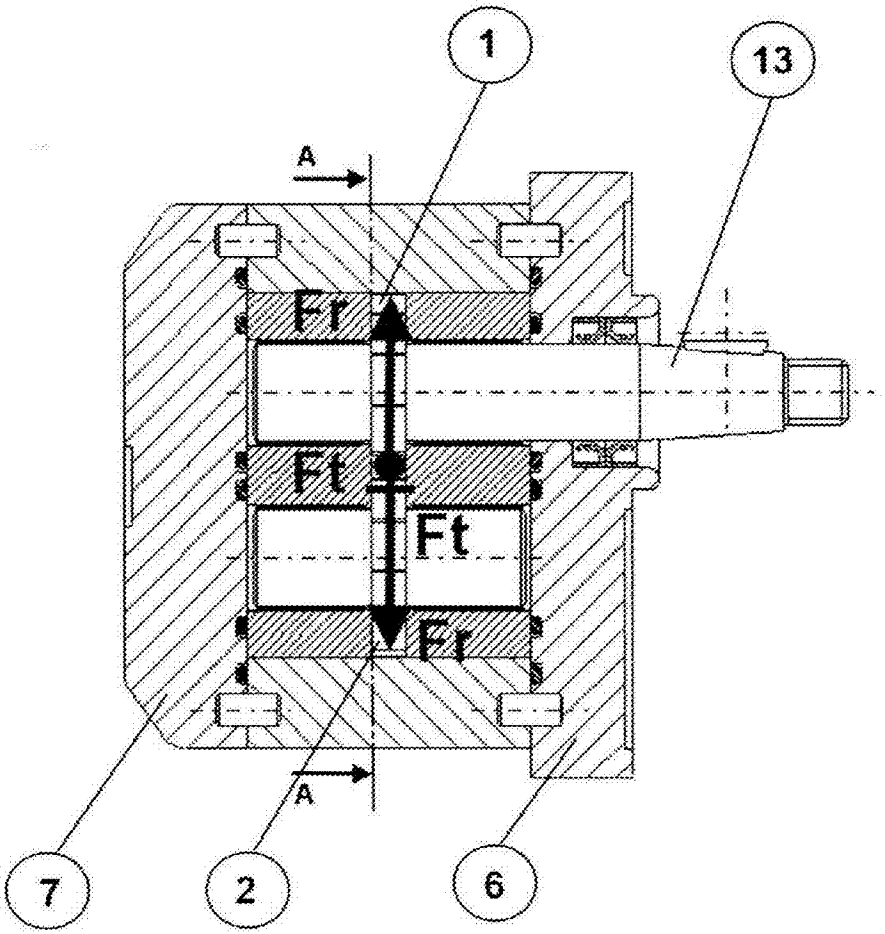
FIG. 2 PRIOR ART
FIG. 2 is the same view as FIG. 1, which shows the radial transmission forces.
Figure 3A:
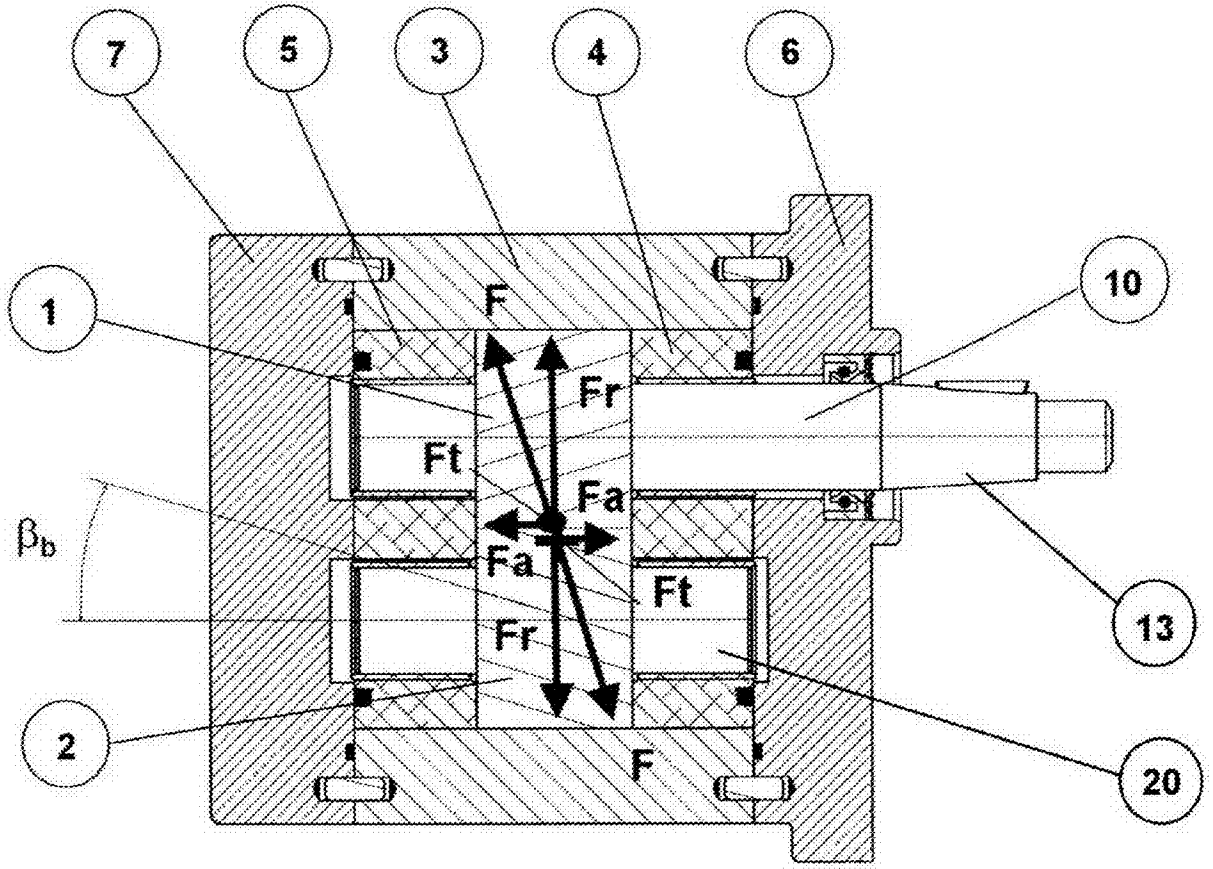
FIG. 3A PRIOR ART
FIG. 3A is an axial view of a gear pump with helical toothing, which shows the radial and axial transmission forces.
Figure 3B:
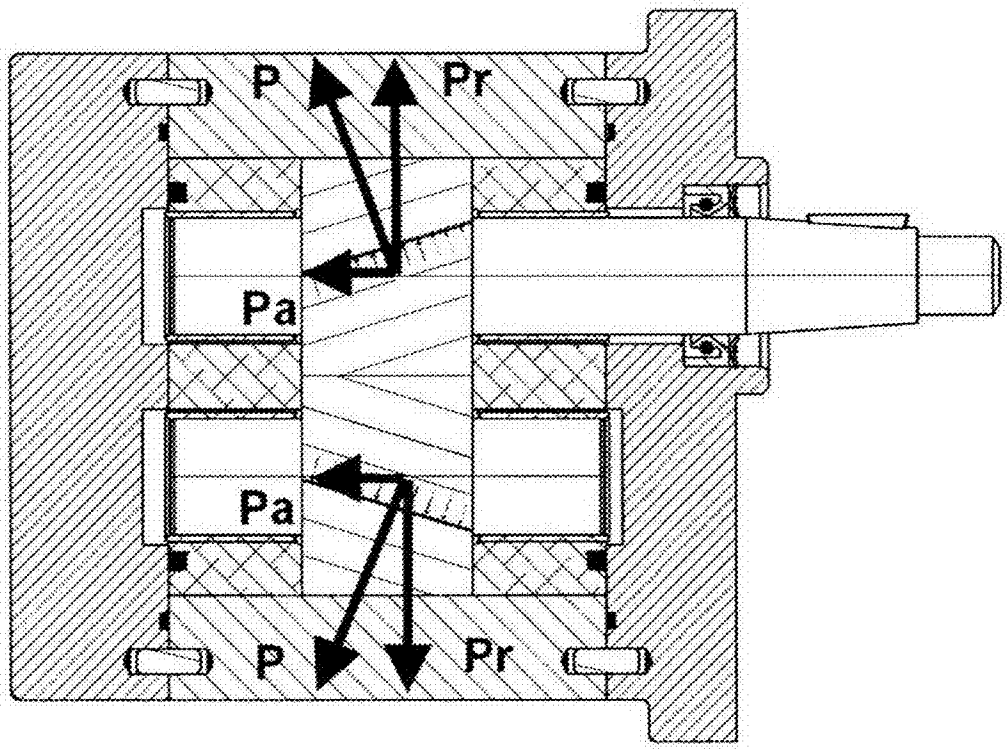
FIG. 3B PRIOR ART
FIG. 3B is the same view as FIG. 3A, which shows the radial and axial pressure forces.
Figure 3D:
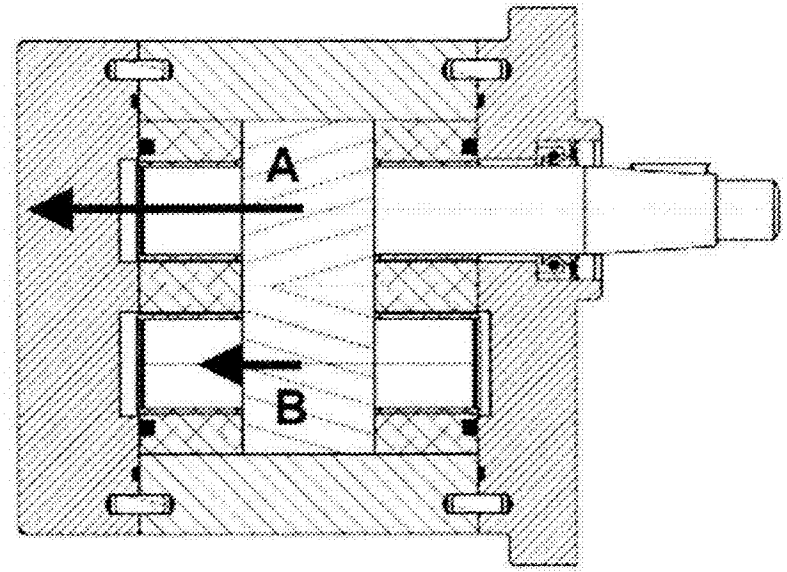
FIG. 3D PRIOR ART
FIG. 3D is the same view as FIG. 3A, which shows the resultants of the axial transmission and pressure forces directed towards the back lid of the pump.
Figure 3C:
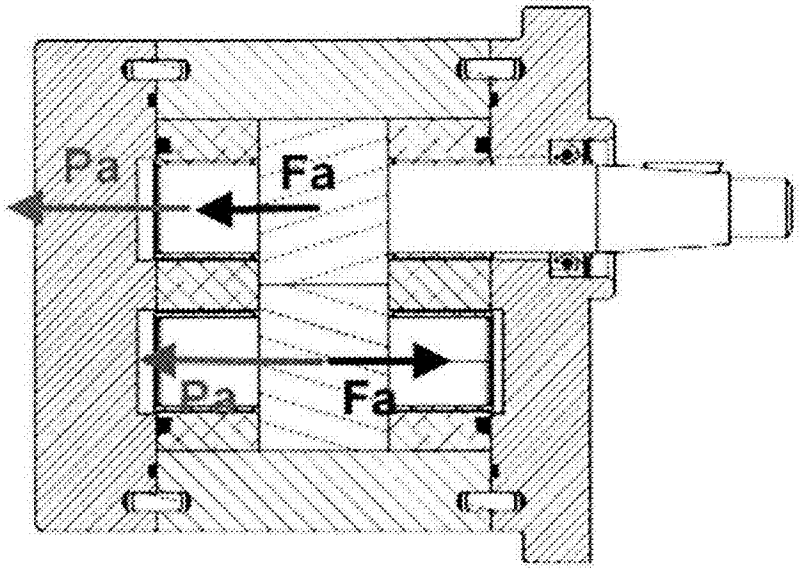
FIG. 3C PRIOR ART
FIG. 3C is the same view as FIG. 3A, which shows the axial transmission and pressure forces when the pump is in left-hand rotation.
Figure 4:
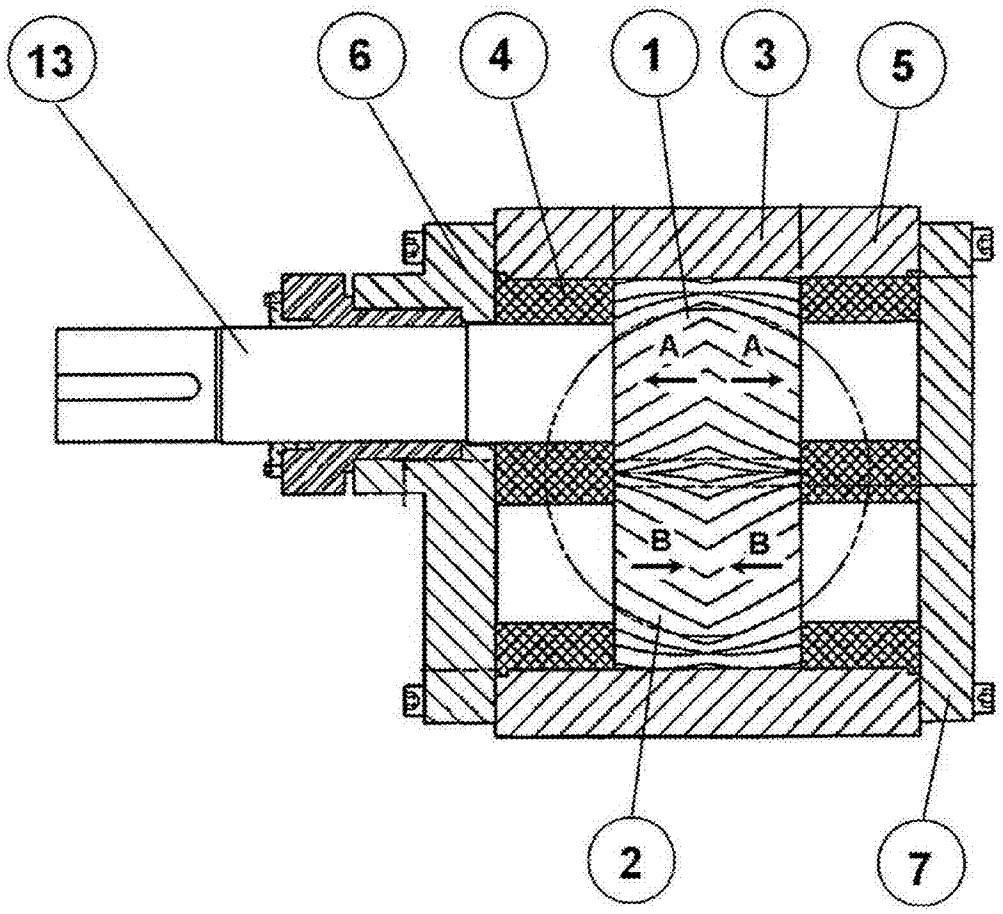
FIG. 4 PRIOR ART
FIG. 4 is an axial view of a bi-helical gear pump according to the prior art.
Figure 5:
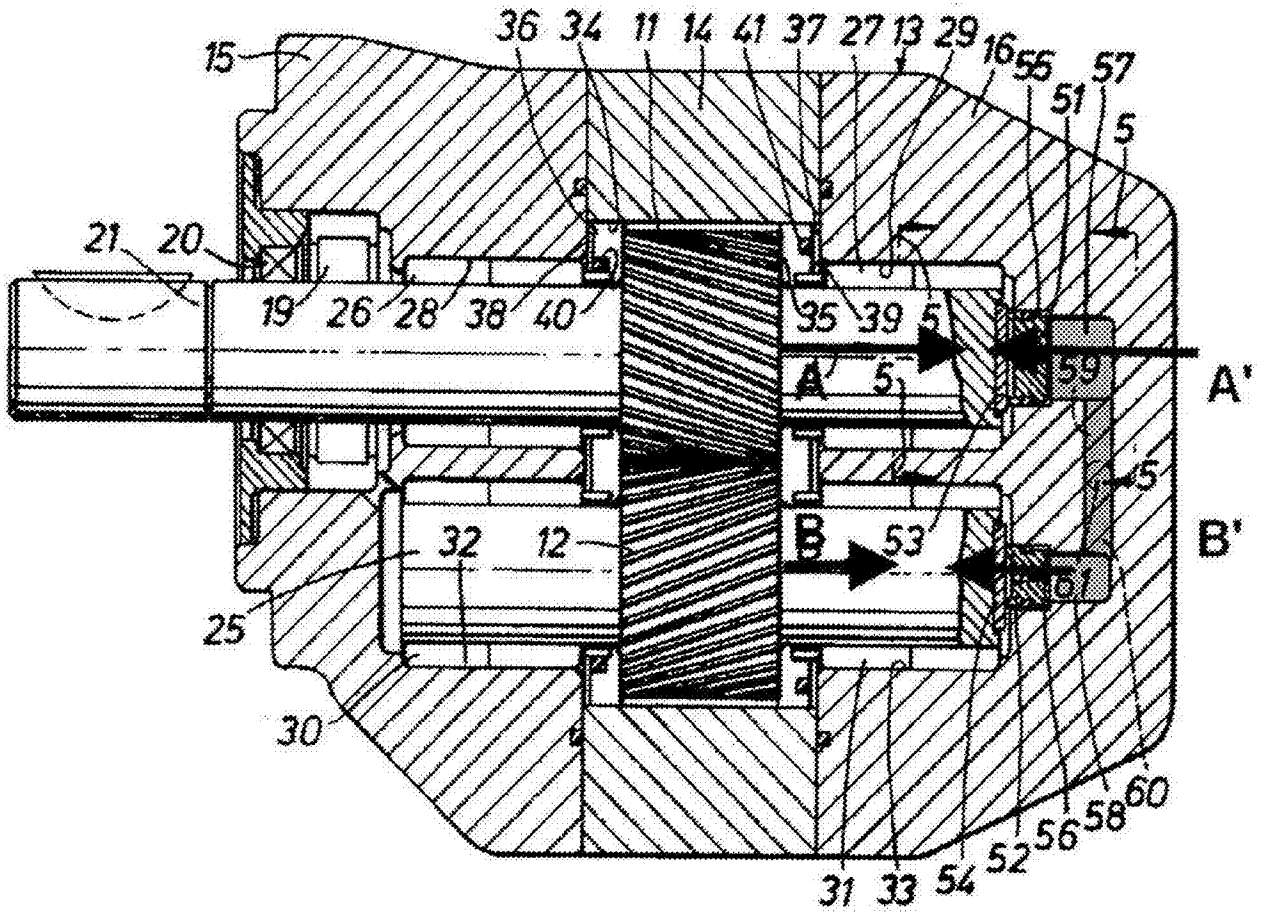
FIG. 5 PRIOR ART
FIG. 5 is an axial view of a helical gear pump according to the prior art, which corresponds to FIG. 1 of U.S. Pat. No. 3,658,452.
Figure 6B:
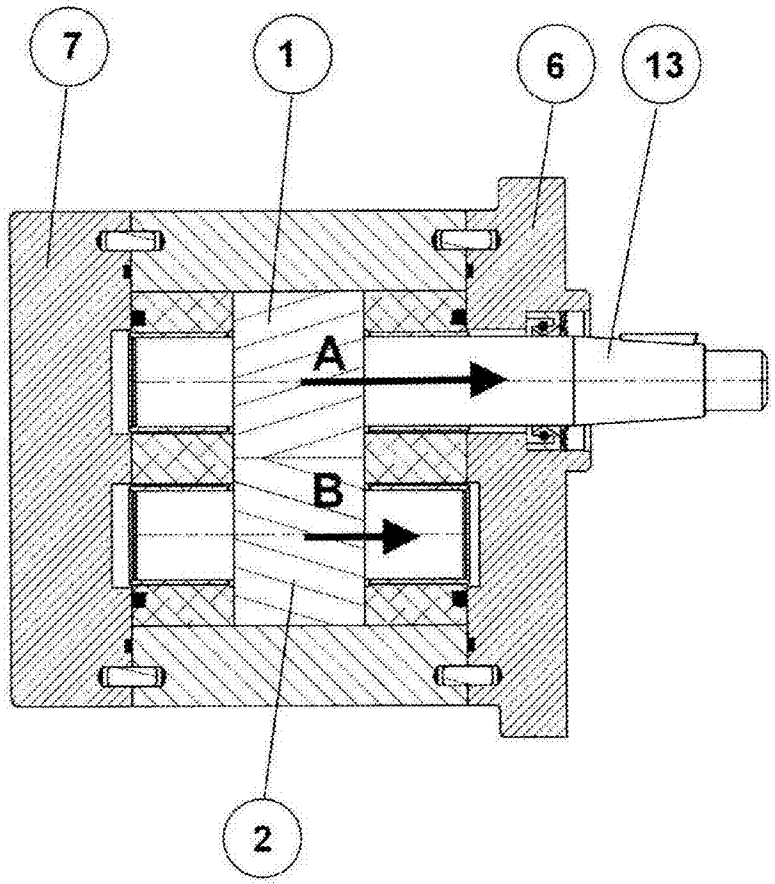
FIG. 6B PRIOR ART
FIG. 6B is the same view as FIG. 6A, which shows the resultants of the axial transmission and pressure forces directed towards the front flange of the pump.
Figure 6A:
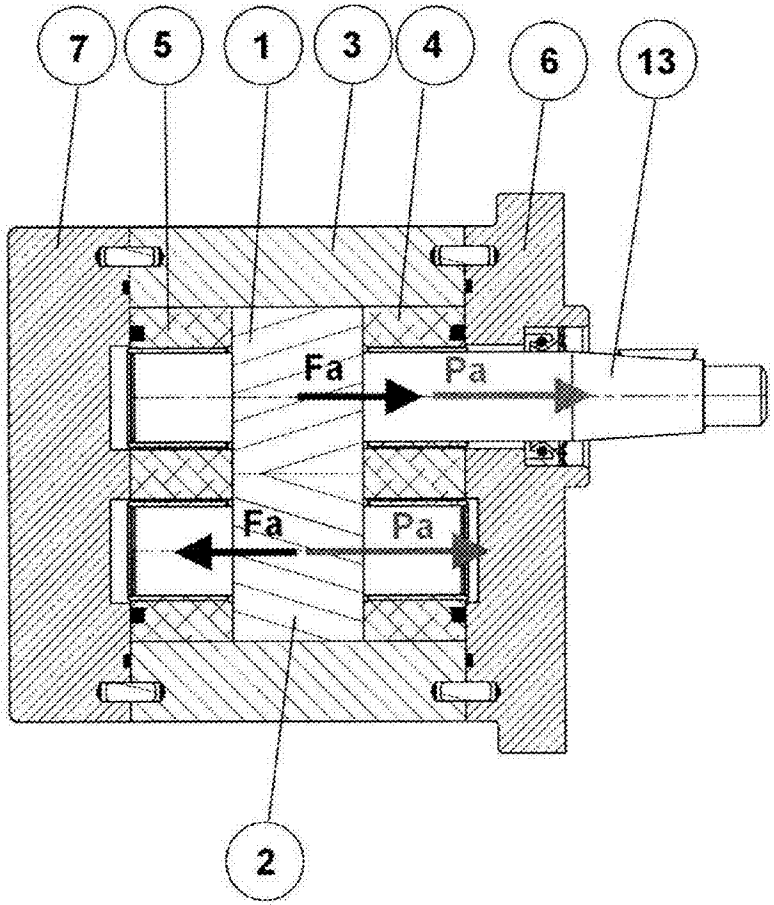
FIG. 6A PRIOR ART
FIG. 6A is the same view as FIG. 3C, which shows the axial transmission and axial pressure forces when the pump is in right-hand rotation.
Figure 7:
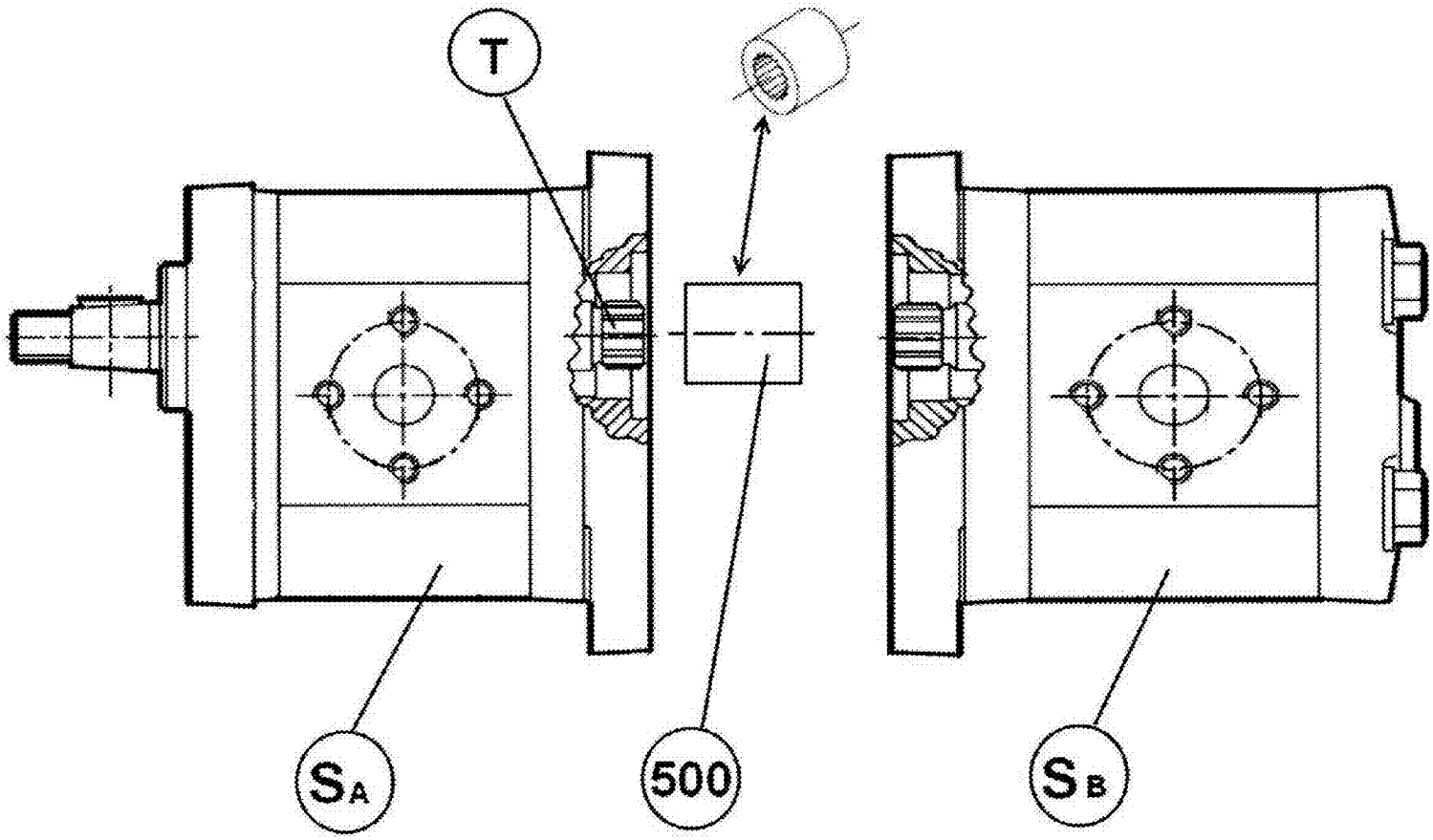
FIG. 7 PRIOR ART
FIG. 7 is a diagrammatic exploded view of two stages of a multiple pump according to the prior art.

Referring to FIGS. 8 to 11, a bi-directional gear pump according to the invention is disclosed, being generally referred to with numeral (100).

Hereinafter elements that are identical or correspond to the elements described above are indicated with the same reference numbers, omitting their detailed description.

The pump (100) comprises a first toothed wheel (1), a second toothed wheel (2), a back lid (7) in closing position and a front flange (6) from which a projecting portion (13) of the shaft protrudes frontally, being connected to the shaft (10) of the first toothed wheel (1). Both toothed wheels (1, 2) are provided with helical toothing.

The projecting portion (13) of the shaft is connected to a motor (M) that can make a kinematic mechanism rotate in clockwise or anticlockwise direction. In such a case, the first toothed wheel (1) is the driving wheel and the second toothed wheel (2) is the driven wheel.

Figure 9:
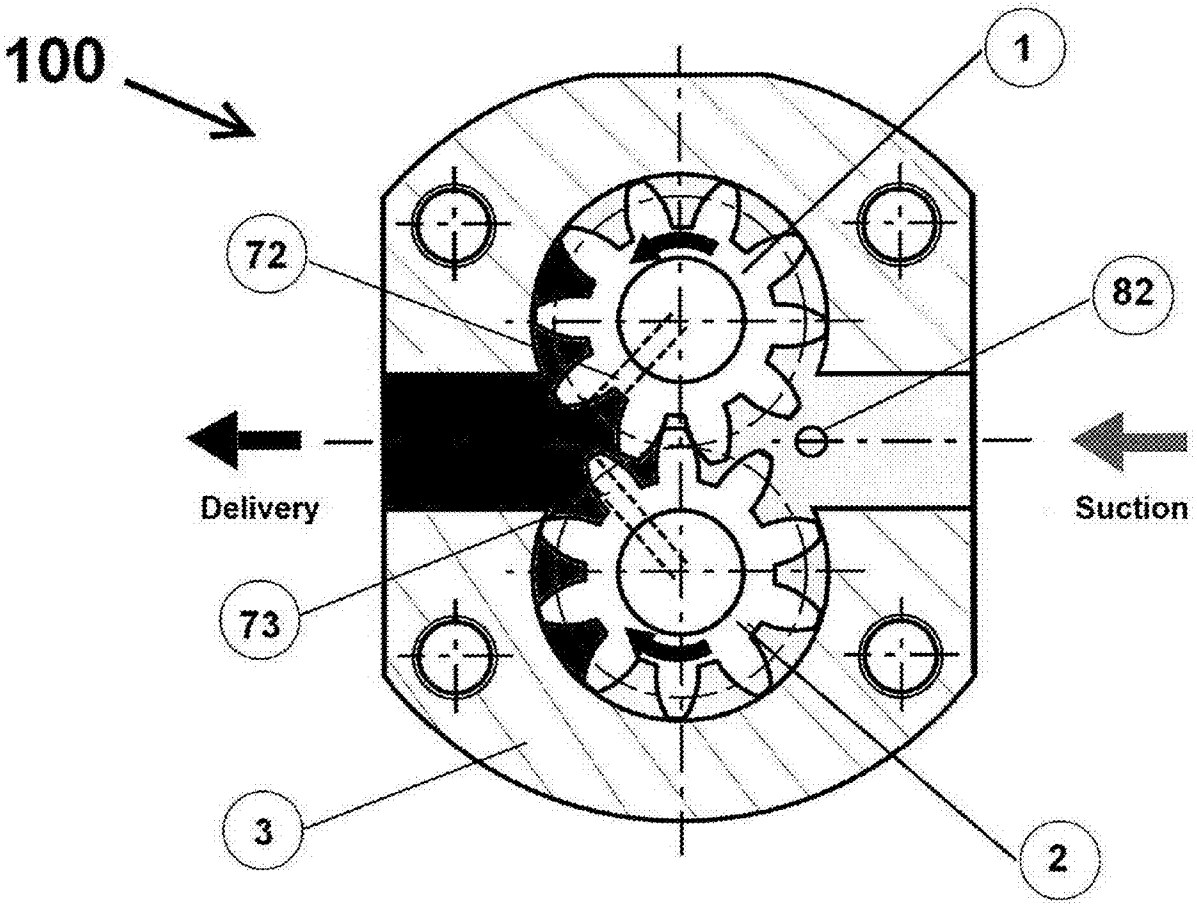
FIG. 9 is a cross-sectional view of the pump of FIG. 8, wherein the inlet area is shown in bold.

With reference to FIG. 9, when the motor (M) makes the driving wheel (1) rotate in anticlockwise direction, an outlet area (high pressure), which is shown in bold, is generated in the left-hand side of the case (3), whereas an inlet area (low pressure) is generated in the right-hand side of the case (3).

Figure 8:
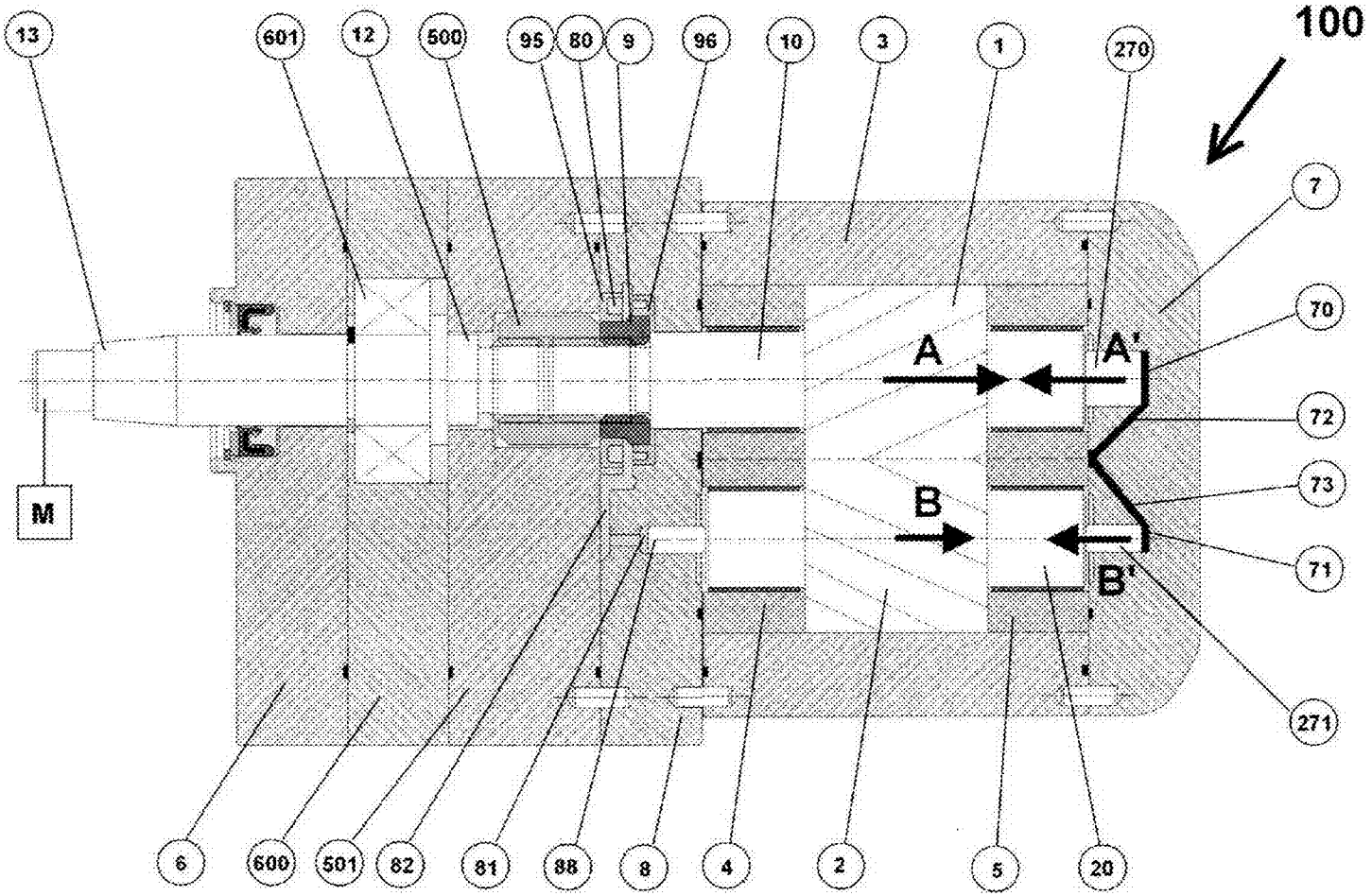
FIG. 8 is an axial view that shows a gear pump of bi-directional type according to the present invention, wherein some high-pressure channels connected to the inlet duct of the pump are shown in bold.

With reference to FIG. 8, in such a case, respective axial forces (A, B) facing towards the back lid (7) are generated on the toothed wheels (1, 2).

The precepts of U.S. Pat. No. 3,658,452 were followed to balance the axial forces (A, B) acting on the back lid (7). Two chambers (70,71) are obtained in the back lid (7), wherein a first piston (270) and a second piston (271) are disposed. The pistons (270, 271) axially actuate on the rear end border of the shafts (10, 20) of the toothed wheels (1, 2).

Two ducts (72, 73) are obtained in the back lid (7), which put the outlet chamber (shown in bold in FIG. 9) of the pump in communication with the chambers (70, 71) of the two pistons (270, 271). In view of the above, the pistons (270, 271) push against the shafts (10, 20) of the toothed wheels, exercising forces (A', B') that balance the axial forces (A, B) acting on the toothed wheels.

Figure 10:
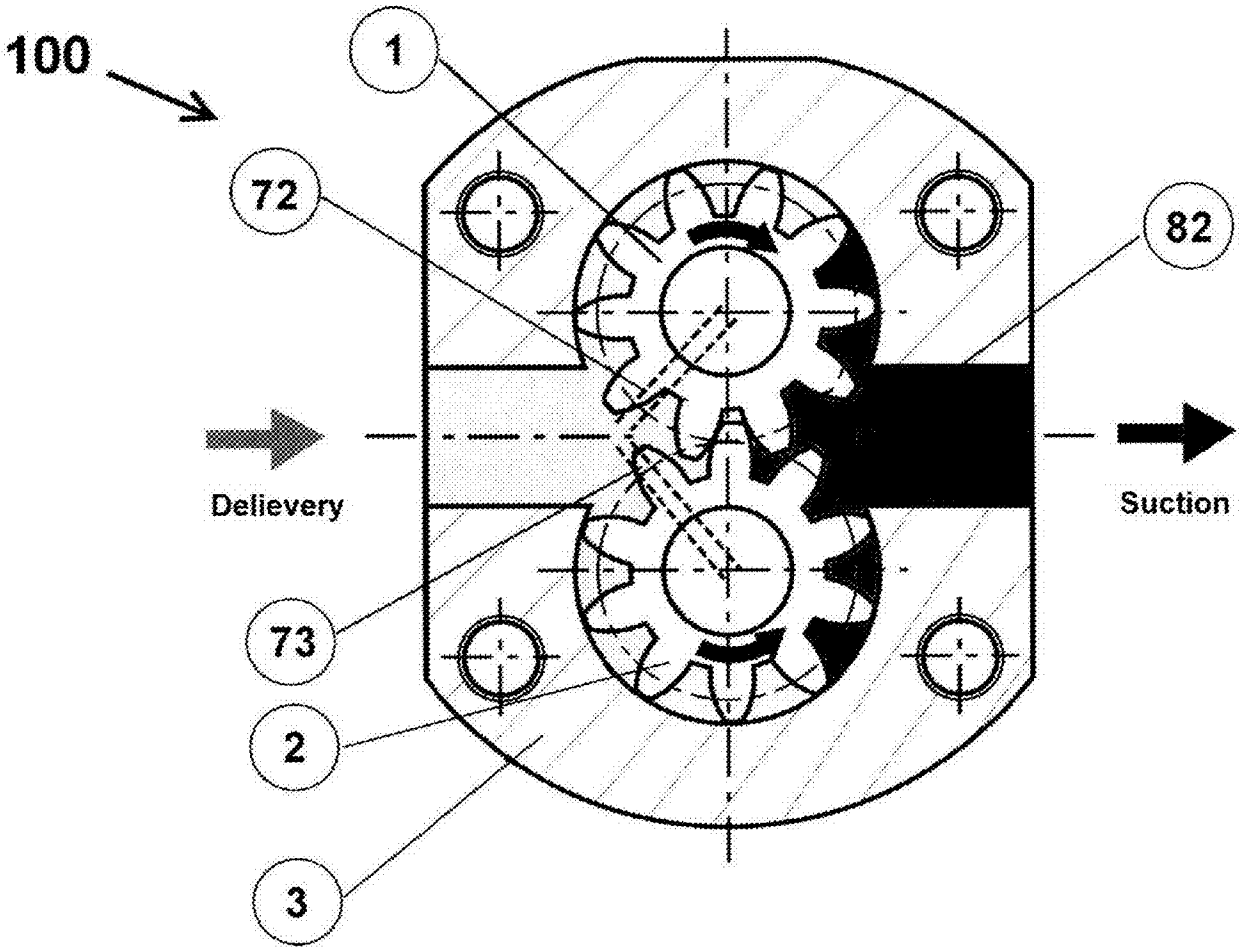
FIG. 10 is the same view as FIG. 9, after inverting the motion, wherein the inlet area is shown in bold.

With reference to FIG. 10, when the motor (M) inverts the rotation direction and puts the driving wheel (1) in clockwise rotation, an outlet area (high pressure), which is shown in bold, is generated in the right-hand side of the case (3), whereas an inlet area (low pressure) is generated in the left-hand side of the case (3).

Figure 11:
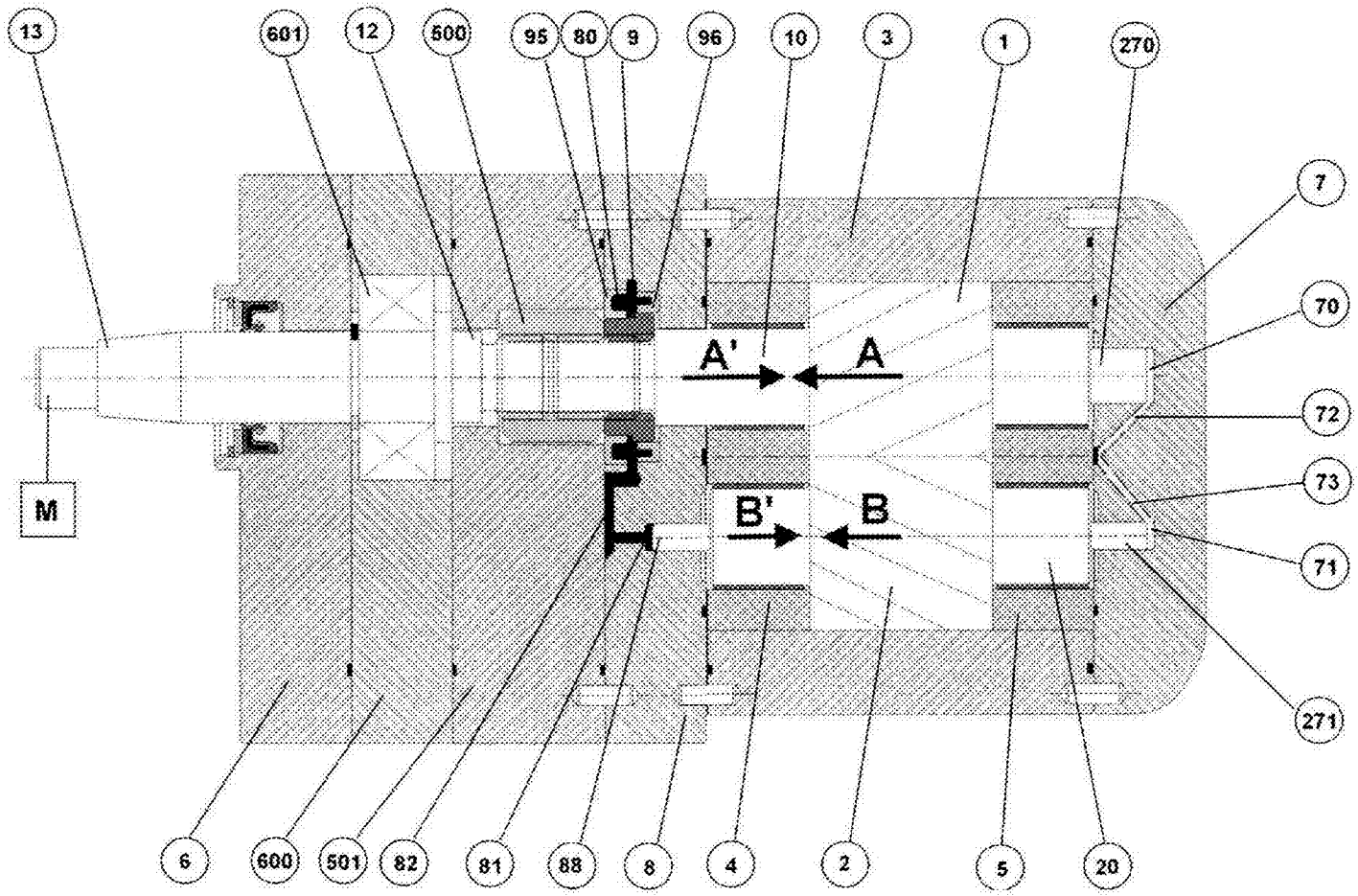
FIG. 11 is the same view as FIG. 9, after inverting the motion, wherein some high-pressure channels connected with the inlet duct of the pump are shown in bold.

With reference to FIG. 11, in such a case, respective axial forces (A, B) facing towards the front flange (6) are generated on the toothed wheels (1, 2).

An intermediate flange (8) is disposed between the case (3) and the front flange (6) in order to compensate said forces (A, B).

Figure 11A:
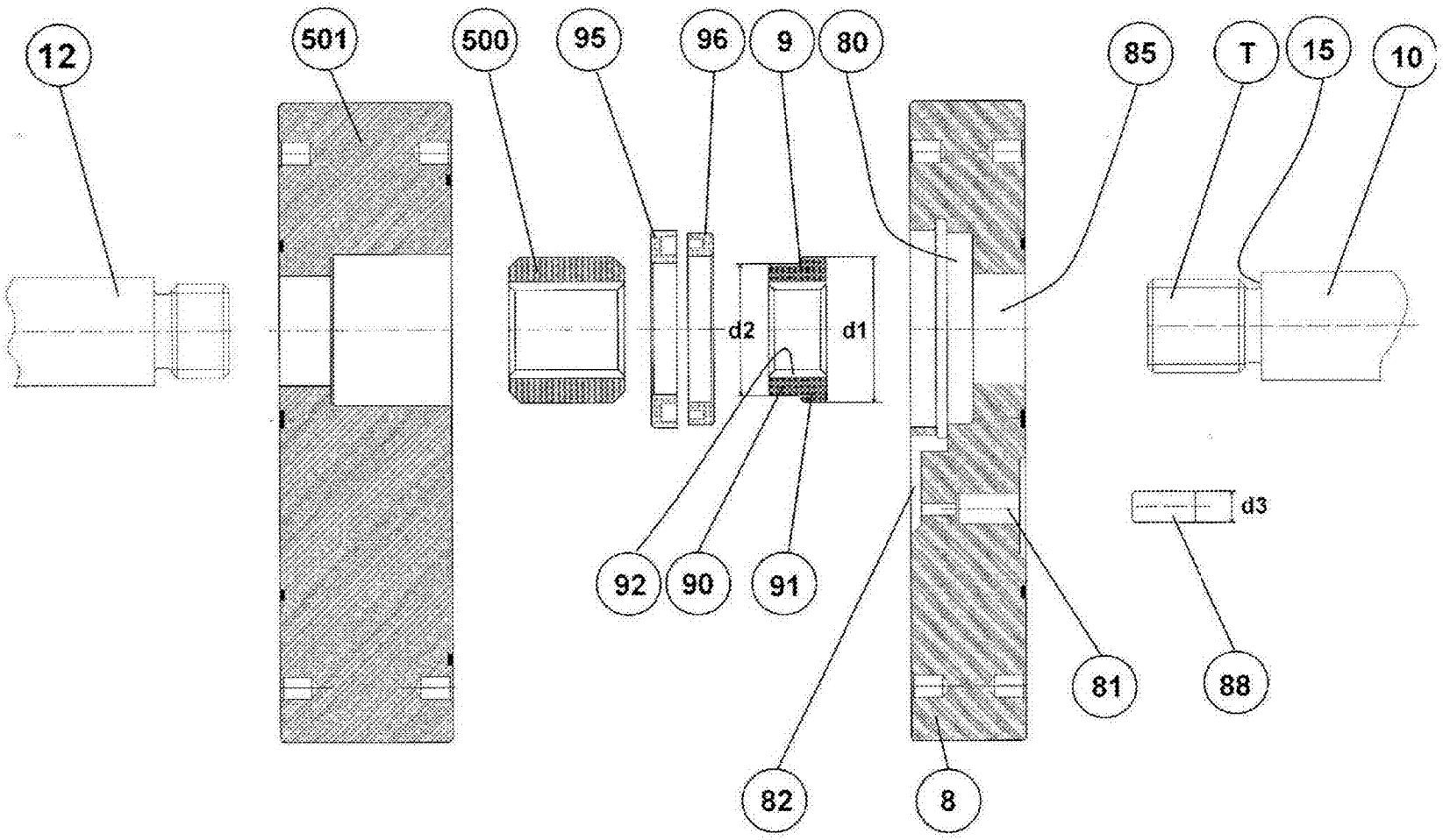
FIG. 11A is an axial exploded view of some elements of the compensation system of the axial thrusts of the pump of FIG. 11.

With reference to FIG. 11A, said intermediate flange (8) is provided with a through hole (85) in order to allow for the passage of an end portion (T) of the shaft (10) of the toothed driving wheel.

The intermediate flange (8) comprises a first chamber (80) with annular shape, obtained around the through hole (85) and a second chamber (81) with cylindrical shape, in axial position to the shaft (20) of the driven wheel (2).

A duct (82) is obtained in the intermediate flange (82) that puts the two chambers (80, 81) in communication with the outlet duct of the pump (shown in bold in FIG. 10).

A compensating ring (9) is provided in the first chamber (80). The compensating ring (9) is inserted on the end portion (T) of the shaft (10) of the driving wheel. To that end, a shoulder (15) is obtained in proximal position to the end portion (T) of the shaft of the driving wheel, against which the compensating ring (9) is stopped. Advantageously, the compensating ring (9) is splined on the end portion (T) of the shaft (10) to avoid undesired friction that may cause fluid leakage from the high-pressure area to the low-pressure area of the pump.

The compensating ring (9) comprises a cylinder (90) and a collar (91) that radially protrudes outwards from the cylinder (90). The compensating ring (9) is internally empty and is provided with a through hole (92) to allow for the passage of the end portion (T) of the shaft of the driving wheel. The through hole (92) has a splined female section, whereas the end portion (T) of the shaft (10) has a splined male section.

Two dynamic seals (95, 96) are disposed in the first chamber (80) of the intermediate flange (8) to support the compensating ring (9) in such way to eliminate possible leakage from the high-pressure areas to the low-pressure areas.

A cylindrical piston (88) is disposed in the second chamber (81) of the intermediate flange.

When the rotation direction of the toothed wheels is as shown in FIG. 10, the chambers (81, 80) of the intermediate flange are in communication with the outlet duct (high pressure), and consequently the fluid pushes the compensating ring (9) and the piston (88) in the direction of the arrows (A', B') (see FIG. 11) in such manner to compensate the axial forces (A, B) exerted on the gears.

With reference to FIG. 11, the collar (91) of the compensating ring has an external diameter (d1) and the cylinder (90) of the compensating ring has an external diameter (d2).

The annular area defined by the diameters $d_1$ and $d_2$ is such to completely compensate the axial force (A). The values of the diameters $d_1$ and $d_2$ are calculated with the formula (7) considering an annular section with equivalent area instead of a circular area. One of the diameters is fixed according to the constructional requirements and the other diameter is calculated with the following formula:

$$\frac{\pi}{4}(d_1^2 - d_2^2) = 2 \cdot \sqrt{\frac{10 \cdot A}{\pi \cdot P}} \text{ [mm]} \tag{9}$$

The piston (88) has an external diameter (d3). The dimension ($d_3$) of the piston (88) is such to completely compensate the axial force (B). The $d_3$ value can be directly calculated from the following formula:

$$d_3 = \Phi_B = 2 \cdot \sqrt{\frac{10 \cdot B}{\pi \cdot P}} \text{ [mm]} \tag{10}$$

According to a preferred embodiment of the present invention, the axial forces are balanced both on the shaft of the toothed driving wheel (1) and on the shaft of the toothed driven wheel (2), respectively by means of the compensating ring (9) and the piston (88). However, it must be considered that the resultant (A) of the axial thrusts on the shaft of the driving wheel (1) is much higher than the resultant (B) of the axial thrusts on the shaft of the driven wheel (2). Therefore the piston (88) is optional and may be omitted.

As shown in FIGS. 8 and 11, the end portion (T) of the shaft of the driving wheel externally protrudes from the intermediate flange (8) and is connected by means of a mechanical connection (500) to a drive shaft (12) provided with said projecting portion (13) connected to the motor (M).

The mechanical connection (500) can be a splined coupling, an Oldham coupling or a coupling of any other type. The mechanical connection (500) is housed in a plate (501) that is stopped against the intermediate flange (8).

An intermediate plate (600) whereon bearings (601) that revolvingly support the shaft (12) can be optionally provided. The intermediate plate (600) is disposed between the front flange (6) and the plate (501) that houses the mechanical connection (500).

Although FIGS. 8 to 11 refer to a pump, said figures may also refer to a hydraulic motor wherein the pump outlet (high-pressure area) corresponds to the inlet of the motor fluid and the pump inlet (low-pressure area) corresponds to the discharge of the motor fluid. In the case of a hydraulic motor, there are no driving wheel and driven wheel, but simply a first toothed wheel (1) and a second toothed wheel (2). Moreover, the projecting portion of the shaft (13) is adapted to be connected to a load, not to a motor (M)

Figure 12:
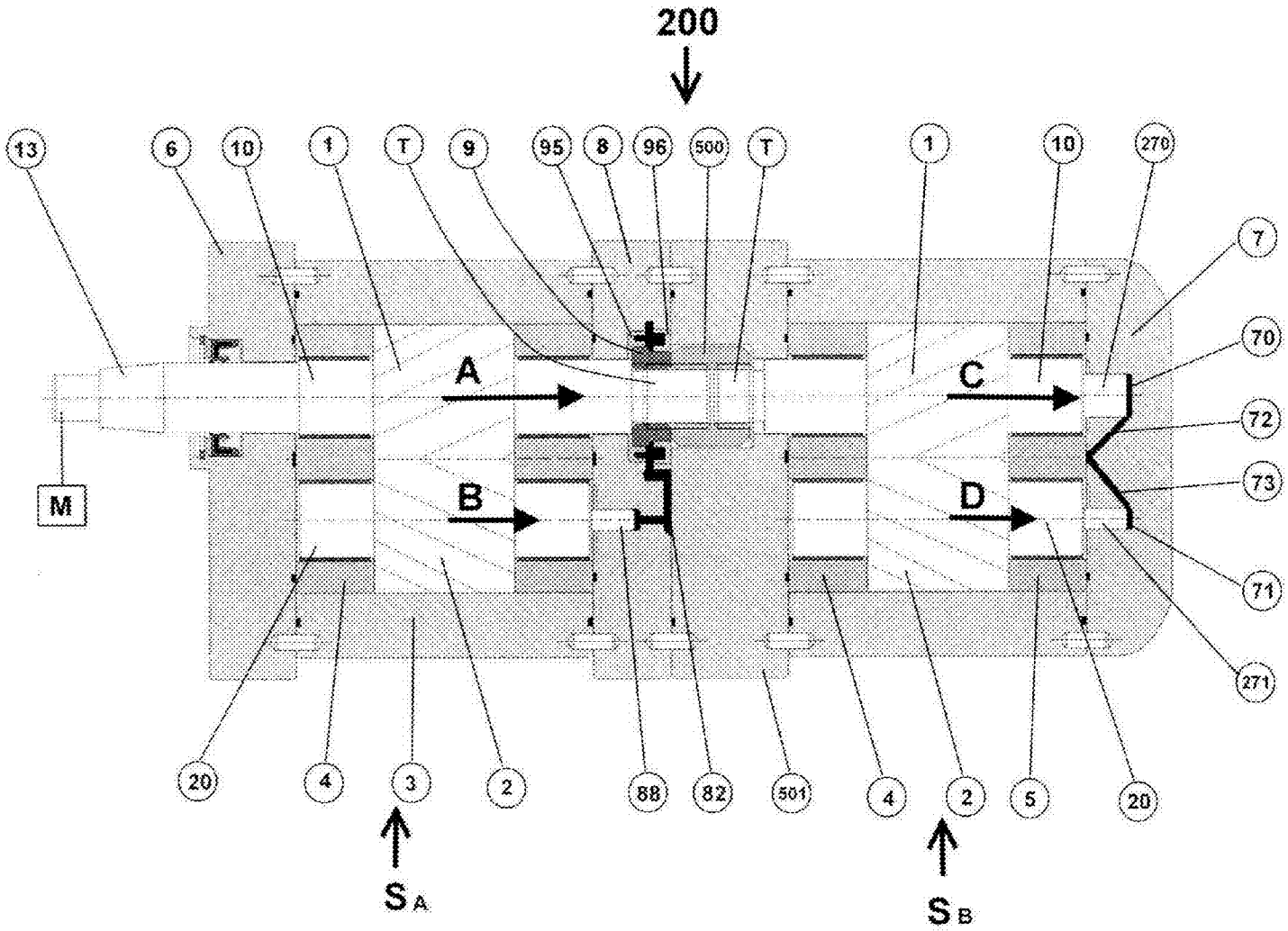
FIG. 12 is an axial view of a multiple stage pump according to the present invention, comprising two stages.
Figure 13:
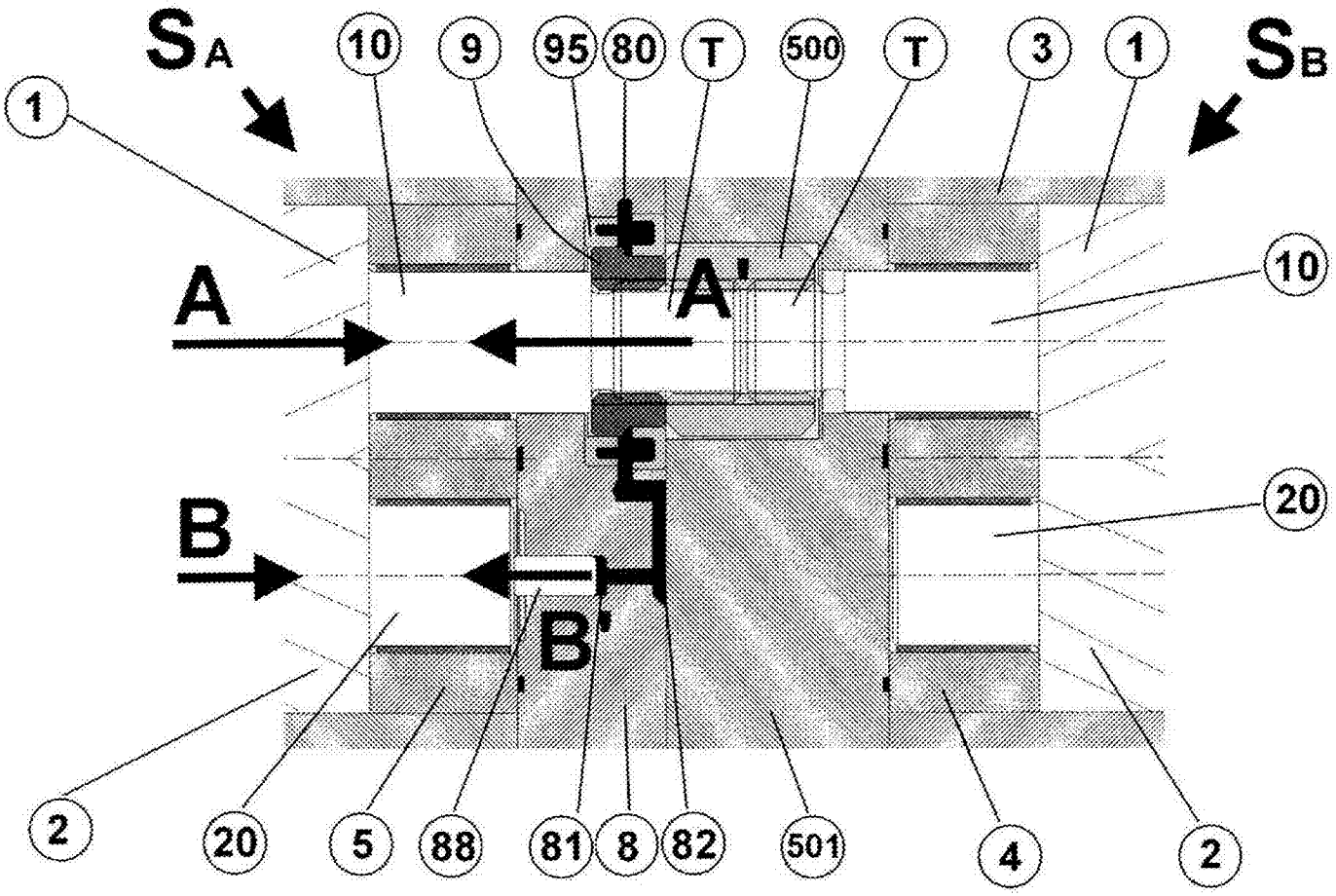
FIG. 13 is an enlarged view of a detail of FIG. 12, which shows the compensation system of the axial thrusts.

FIGS. 12, 13 illustrate a multiple gear pump (200).

The multiple gear pump (200) comprises a front stage ($S_A$) and a rear stage ($S_B$). Each stage comprises toothed wheels with helical toothing.

The rear stage ($S_B$) is the last stage of the pump and therefore is closed with the back lid (7), from which no shaft protrudes. A projecting portion (13) of the shaft frontally protrudes from the front flange (6) to be connected to a motor (M).

The end portion (T) of the shaft of the driving toothed wheel of the front stage ($S_A$) is connected to the end portion (T) of the shaft of the toothed driving wheel of the rear stage ($S_B$) by means of the mechanical connection (500) housed in the plate (501) disposed between the two stages ($S_A$, $S_B$).

In such a case, the toothed wheels of the front stage and of the rear stage are subject to respective axial forces (A, B, C, D), which are all directed towards the back lid (7).

Consequently, the axial forces (C, D) on the toothed wheels of the rear stage ($S_B$) are balanced by the action of the pistons (270, 271) disposed in the back lid (7).

Instead, the axial forces (A, B) on the toothed wheels of the front stage ($S_A$) are balanced by the action of the compensating ring (9) and of the piston (88) disposed in the intermediate flange (8). As shown in FIG. 13, the compensating ring (9) and the piston (88) generate respective axial forces (A', B') that compensate the axial forces (A, B) exerted on the toothed wheels (1, 2) of the front stage ($S_A$).

The plate (501) that houses the mechanical connection (500) is disposed between the intermediate flange (8) and the rear stage ($S_B$).

Figure 14:
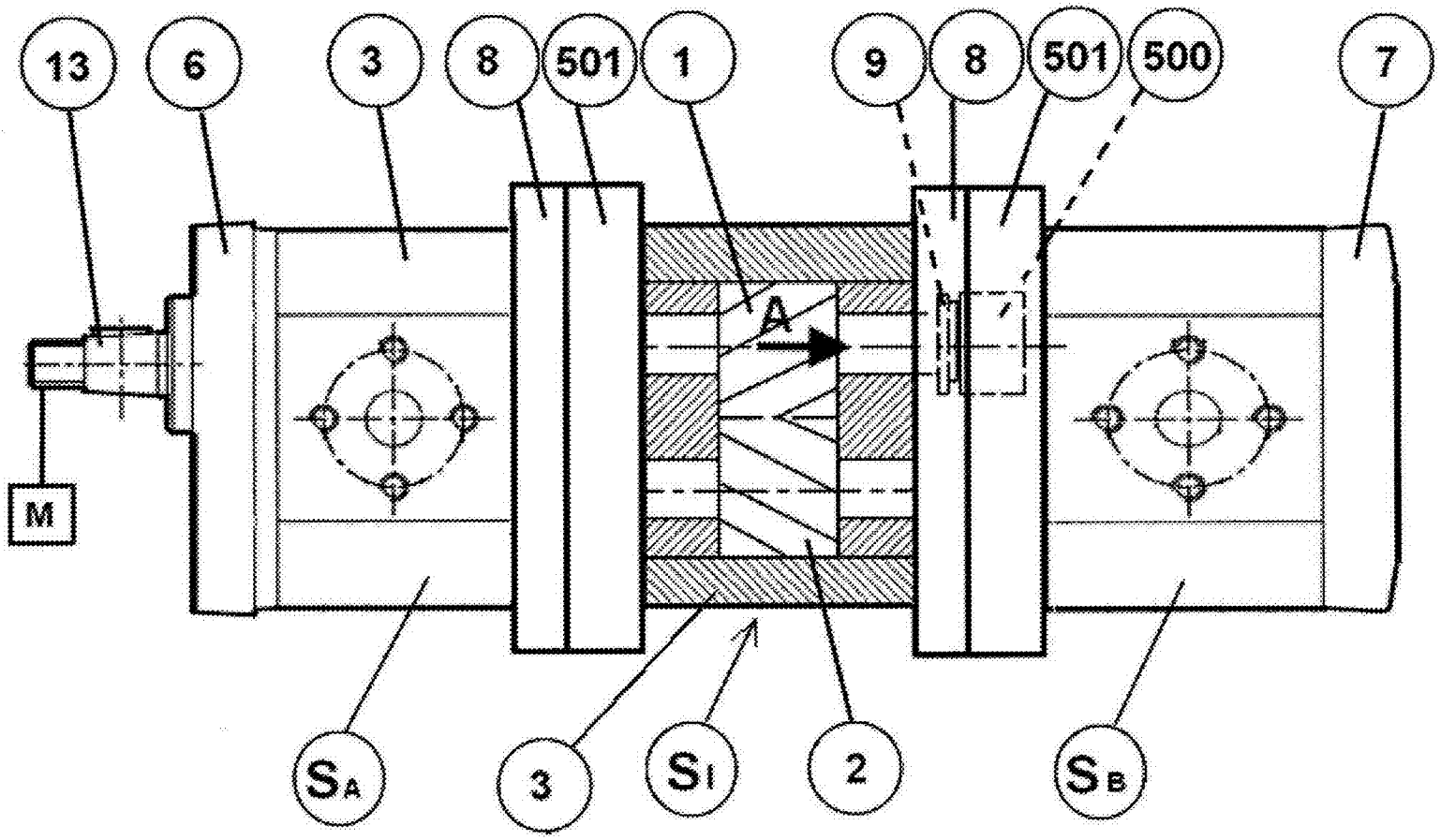
FIG. 14 is a partially axial view of a multiple stage pump according to the present invention, comprising three stages.

Referring to FIG. 14, the multiple gear pump (200) may comprise one or more intermediate stages ($S_I$) disposed between the front stage ($S_A$) and the rear stage ($S_B$). Each intermediate stage ($S_I$) comprises a first toothed wheel (1) and a second toothed wheel (2) with helical toothing. The first toothed wheel (1) of the intermediate stage ($S_I$) receives the motion from the end portion (T) of the shaft of the driving wheel (1) of the frontally positioned stage ($S_A$) and in turn gives motion to a posterior stage ($S_B$) by means of the mechanical connection (500) that connects the shaft of the first toothed wheel of the intermediate stage to the shaft of the first toothed wheel of the posterior stage ($S_B$).

In such a case, an additional intermediate flange (8) is disposed between the case of the intermediate stage ($S_I$) and the mechanical connection (500). The compensating ring (9) of the intermediate flange (8) compensates the axial thrust (A) of the first toothed wheel (1) of the intermediate stage ($S_I$).

Variations and modifications can be made to the present embodiments of the invention, within the reach of an expert of the field, while still falling within the scope of the invention.

The invention claimed is:

1. A gear pump or hydraulic gear motor comprising:

a first shaft;

a first toothed wheel joined to said shaft;

a second shaft;

a second toothed wheel joined to said second shaft and engaged with said first toothed wheel, said first and second toothed wheels each having helical teeth;

a plurality of supports revolvingly supporting said first and second shafts of said first and second toothed wheels;

a case containing said plurality of supports and defining an inlet fluid duct and an outlet fluid duct;

a front flange from which a projecting portion of said first shaft protrudes frontally, said front flange being connected to said first shaft of said first toothed wheel, said projecting portion of said first shaft being adapted to be connected to a motor or to a load; and a back lid fixed to said case;

an intermediate flange disposed between said case and said front flange, said intermediate flange comprising a first chamber connected by a connection duct to said inlet fluid duct or said outlet fluid duct;

a compensating ring mounted in said first chamber of said intermediate flange and inserted on a portion of said first shaft of said first toothed wheel; in such manner to compensate for axial forces imposed on said first toothed wheel and to allow for motion transmission on said first shaft of said first toothed wheel, wherein said compensating ring comprises an internally empty cylinder and a collar radially protruding from said cylinder, wherein an external diameter of said cylinder and said collar are selected to compensate for the axial forces imposed on said first toothed wheel.

2. The gear pump or hydraulic gear motor of claim 1, further comprising:

a second chamber formed in said intermediate flange and connected by said connection duct to said inlet fluid duct or said outlet fluid duct of the pump; and a piston mounted in said second chamber of said intermediate flange in order to stop against one end of said shaft of said second toothed wheel, in such manner to compensate for axial forces imposed on said second toothed wheel.

3. The gear pump or hydraulic gear motor of claim 1, wherein said portion of said first shaft of said first toothed wheel whereon said compensating ring is inserted is an end portion and the gear pump also comprises a mechanical connection connecting said end portion of the toothed wheel to another shaft so as to transmit motion.

4. The gear pump or hydraulic gear motor of claim 1, wherein said compensating ring is keyed on said portion of said first shaft so as to eliminate relative friction.

5. The gear pump or hydraulic gear motor of claim 1, further comprising:

a plurality of dynamic seals disposed in said first chamber of the intermediate flange to support said compensating ring in such manner to avoid leakage from high pressure areas towards low pressure areas.

6. The gear pump or hydraulic gear motor of claim 1, wherein said back lid comprises:

a first chamber and a second chamber connected by ducts to inlet fluid duct or to said outlet fluid duct;

a first piston mounted in said first chamber of back lid in order to stop against an end of said first shaft of said first toothed wheel so as to compensate for axial forces imposed on said first toothed wheel; and a second piston mounted in said second chamber of said back lid in order to stop against an end of said second shaft of said second toothed wheel so as to compensate for axial forces imposed on said second toothed wheel.

7. The gear pump or hydraulic gear motor of claim 1, further comprising:

a mechanical connection connecting said first shaft of said first toothed wheel to a drive shaft comprising said projecting portion that protrudes from said front flange.

8. The gear pump or hydraulic gear motor of claim 1, wherein said projecting portion of said first shaft is connected to a motor such that said first toothed wheel is a driving wheel and said second toothed wheel is a driven wheel.

9. The gear pump of hydraulic gear motor of claim 1, wherein said projecting portion of said first shaft is connected to a load.

10. The gear pump or hydraulic gear motor of claim 1, wherein said gear pump or hydraulic gear motor is multiple and comprises:

at least one front stage comprising said first toothed wheel and said second toothed wheel;

a rear stage comprising another said first toothed wheel and another said second toothed wheel and said back lid; and a mechanical connection connecting said first shaft of said first toothed wheel of said front stage to the first shaft of another said first toothed wheel of said rear stage;

wherein said intermediate flange is disposed between said case of said front stage and said mechanical connection and said compensating ring of said intermediate flange compensates for an axial thrust of said first toothed wheel of said front stage.

11. The gear pump or hydraulic gear motor of claim 10, further comprising:

at least one intermediate stage between said front stage and said rear stage, the intermediate stage comprising a first toothed wheel and a second toothed wheel with each helical teeth, the first toothed wheel of said intermediate stage receiving motion from an end section of the shaft of said first toothed wheel of said front stage and moves said rear stage through the mechanical connection connecting said shaft of said first toothed wheel of said intermediate stage to said first shaft of said first toothed wheel of said rear stage, wherein an additional intermediate flange is disposed between the case of said intermediate stage and the mechanical connection, said additional intermediate flange comprising a compensating ring to compensate for axial thrust of said first toothed wheel of said intermediate stage.

* * * * *